US009190041B1

(12) United States Patent
Miller

(10) Patent No.: US 9,190,041 B1
(45) Date of Patent: Nov. 17, 2015

(54) NECKDIVE STRAP

(71) Applicant: Richard Miller, Joshua Tree, CA (US)

(72) Inventor: Richard Miller, Joshua Tree, CA (US)

( * ) Notice: Subject to any disclaimer, the term of this patent is extended or adjusted under 35 U.S.C. 154(b) by 0 days.

(21) Appl. No.: 14/453,210

(22) Filed: Aug. 6, 2014

(51) Int. Cl.
*G10D 3/00* (2006.01)
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 5,291,816 A * 3/1994 Adams ..... 84/327
5,596,158 A * 1/1997 Tonon ..... 84/327
5,936,173 A * 8/1999 Tonon ..... 84/327
6,189,158 B1 * 2/2001 Lehoux ..... 2/455
6,250,525 B1 * 6/2001 Lehoux ..... 224/257
6,576,823 B1 * 6/2003 Wise, Jr. ..... 84/327
7,009,097 B1 * 3/2006 Terplivetz ..... 84/327
8,237,036 B2 * 8/2012 Naylor ..... 84/327
8,618,393 B1 * 12/2013 Peters ..... 84/327
2011/0017789 A1 * 1/2011 Wells ..... 224/250
2013/0139668 A1 * 6/2013 Aires ..... 84/267
2013/0298747 A1 * 11/2013 Werges ..... 84/327
2014/0208920 A1 * 7/2014 Creek ..... 84/327

* cited by examiner

*Primary Examiner* — Robert W Horn

(57) ABSTRACT

A leg strap, that connects a guitar or bass player's upper thigh to the shoulder-strap end pin, located on the body of a guitar or bass, for the purpose of supporting the instrument in a stationary playing position, eliminating an adverse condition known as "neck-dive", which is the tendency in unbalanced and neck-heavy instruments for the neck-portion of the instrument to drop in a downward direction when both hands are taken off the instrument.

8 Claims, 2 Drawing Sheets

NECKDIVE STRAP

BACKGROUND OF THE INVENTION

Many basses, vintage guitars, and guitars with more than one neck (doublenecks), have necks that are heavier than the instrument bodies they are joined to. In these instances, when a player of an unbalanced instrument releases both hands from the instrument, they lose control over the instrument. The result is the neck of the instrument "drops" or "dives". Attention dedicated to this problem has focused primarily on what the neck is doing: dropping in height. However, we concerned owners of these unbalanced guitars and basses were focusing on the wrong end of the instrument. We looked endlessly at the guitar or bass "neck", and its heavy head stock and tuners, and wondered how we could prevent it from "falling". No adequate solution has ever presented itself by looking at and focusing on "the neck". But what else was there to look at? As soon as I asked that question, the current embodiment of this invention slowly came into view, and the creation of The Neckdive Strap began to take form. What if we turn the problem "on its head", and start thinking in "opposites"? If something is "falling", it stands to reason that somewhere else, something is "rising". It then stands to reason that as the neck of the instrument is "falling" in height, the opposite end of the instrument is "rising". Upon observing this phenomenon, it became apparent that if an instrument body's furthest and opposite end-point from the neck could be prevented from rising, the neck would no longer drop, or "dive", when a player released both hands from the instrument. The standard shoulder strap end pin (FIG. 1, #3) was observed to be the optimal location for some kind of strap to prevent this "rise". Upon further investigation, this strap could use a player's leg to provide the anchor point. A prototype was made from an old pant belt, and accomplished the sought after results. The current embodiment has added features of a quick release leg buckle (4), two adjustable buckles for leg girth (4) and strap length (5), and an option for using an off the shelf strap lock to connect the strap end hole (3*a*) to the instrument end pin (3).

SUMMARY OF THE INVENTION

The Neckdive Strap overcomes the deficiencies of prior support systems by focusing attention not on the neck of the instrument, but on the opposite end of the guitar or bass, specifically, the shoulder strap end pin. As the neck drops in height, the end pin on the opposite side of the guitar rises. Preventing this rise is the purpose of the current invention. The Neckdive Strap uses the players leg as the anchor point, and attaches to the end pin of any instrument that is played in a standing position with a standard guitar or bass shoulder strap. The unique embodiment and configuration of the prior art [Strap (1,6,7), buckles (4,5), leather end (2)] used in this current invention, for the specific purposes stated, namely, its use to eliminate the long-standing problem encountered by guitarists and bassists of the condition known as "neck-dive", demonstrates a unique use and assembly of those individual components, and therefore qualifies this unique invention and all of its claims, for patent protection.

BRIEF DESCRIPTION OF THE INVENTION

FIG. 1 is a side view of a player wearing the leg support strap, connected to the same end pin of a guitar that a standard shoulder strap is attached to.

DETAILED DESCRIPTION OF THE PREFERRED EMBODIMENT

Figure 1:
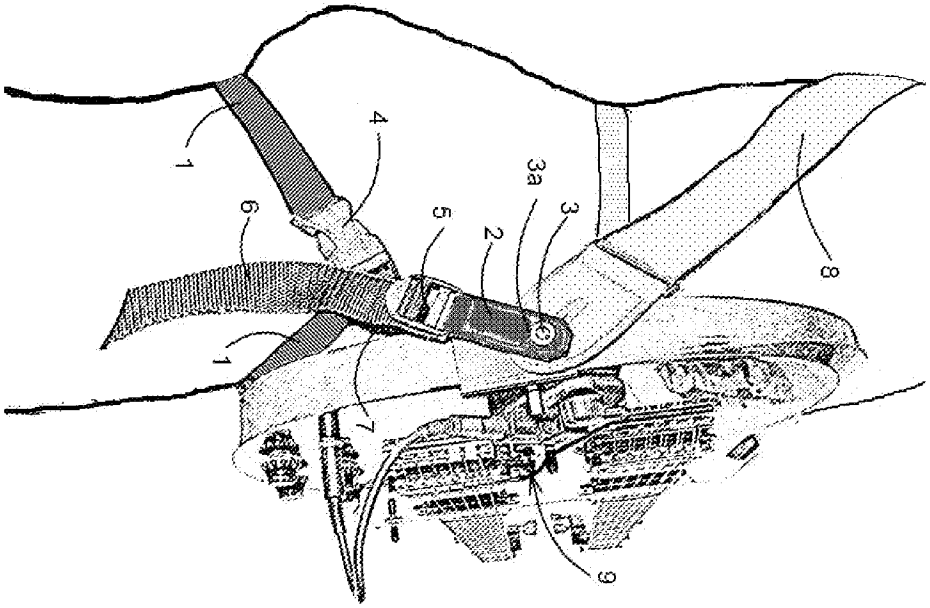

Shown in FIG. 1 is a side view illustration of a player with a typical neck-heavy instrument, a doubleneck guitar (9), with a standard shoulder strap (8) attached to the endpin (3) of the guitar. Attached to this same endpin (3) is the leg-encircling Neckdive Strap (1 THRU 7). The leg-encircling portion of the strap (1) is connected by a quick-release single adjustable buckle (4). This adjustable buckle provides two functions: it allows the strap to be easily attached or detached from around the player's upper thigh portion of the leg, and it adjusts the girth of the strap so that it can fit any person's width or leg circumference. The strap continues out of the adjustable portion of this first buckle (4) and creates the length portion of the strap (7—partially hidden by 6, but fully viewable in FIG. 2). This "length" portion of the strap will, in most cases, be relatively short, due to the close proximity of the leg to the guitar end pin. This length is fully adjustable, on the fly, by the next buckle (5). The continuous length of strap is now threaded through the second adjustable buckle (5), which has as part of its features a loop end. The remainging strap, used as a length of strap for easily making final neck height adjustments to the guitar, hangs down from the second buckle, and is easily accessible by the player. Attached to the loop portion of this buckle is a leather strap end (2), with a hole punched into it (3*a*), which is then placed onto the same end pin (3) as the previously mentioned shoulder strap (8).

Figure 2:
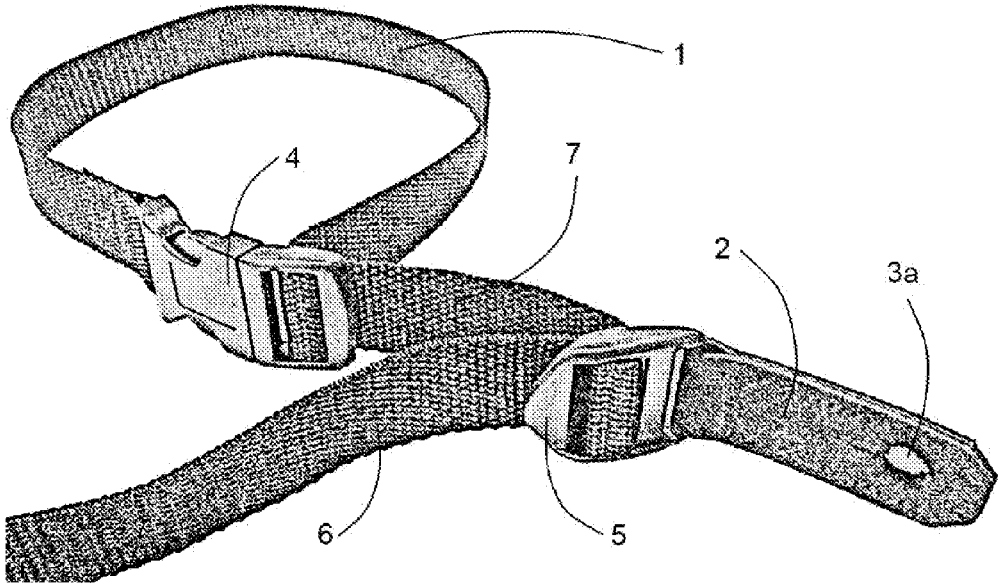
FIG. 2 is an overhead view of the strap showing all its parts, buckles, and how it is assembled. The large loop encircles the upper thigh of the player's leg (1), is joined by a quick-release single adjustable buckle, and continues (7) into another adjustable buckle (5) with a leather strap end sewn into its end (2).

FIG. 2 illustrates a side-overhead view of the preferred embodiment of the neckdive-prevention strap. A single, continuous strap (1,7,6) is threaded through two different buckles (4,5), and has a leather strap end attached to the loop end of the second buckle (5). Strap portion (1) forms a large loop which encircles the players leg, and is attachable and detachable by use of the quick release buckle (4). The quick release buckle also has an adjustment feature to it, which allow the player to size this portion of the strap to fit the circumference of his or her leg. The strap then continues out of the adjustment portion of this first buckle (4) and creates the length portion of the strap (7). This length portion determines the distance of the strap from the leg to the instrument's end pin (3 in FIG. 1), and serves to allow the player to adjust the angle of the neck(s) of the instrument to the desired height. This adjustment is achieved by the implementation of a second buckle (5), which the remaining portion of the single, continuous strap is threaded through, leaving the remaining strap to hang down, within reach of the player, for easy access in case on the fly adjustments are desired. Also attached to this second buckle (5), on its opposite end, where there is a loop, is a leather strap piece, or leather strap end (2), with a hole punched into it (3*a*), which attaches to the end pin (3 in FIG. 1) of the neck heavy instrument (9 in FIG. 1).

In use, the player first wants to adjust the leg portion of the strap so it fits comfortably and securely, around the circumference of their leg. This is done by releasing the leg buckle's (4) quick-release lock, wrapping the leg portion of the strap around the leg, rejoining the buckle, and then pulling or pushing the strap through the quick-release buckle's adjustable portion. Once a suitable adjustment is made, the strap is unbuckled, and the player puts the guitar or bass on. Once the instrument is on, the player attaches the strap back onto the leg, and then places the strap's leather strap end (2) onto the same end pin that the shoulder strap (8 —FIG. 1) is connected to, on the back end of the body of the instrument (3 —FIG. 1) The final adjustment of the angle of the instrument, or height of the neck, is made now, whether by pulling on the excess length of strap (6) to shorten the length of 7, or by pulling up on the buckle "tab" (5), lengthening 7 and therefore lowering the height of the neck, or decreasing the angle of the instrument. Once the strap is attached to the instrument end pin, the instrument is held firmly in place, and the neck cannot move down, or "dive. It can still move up, or out, or towards the player's body, retaining almost complete freedom of movement of the instrument as before. The problem however, of the instrument taking a "dive", has been eliminated.

While the present invention has been described and illustrated with respect to the preferred embodiment, it will be appreciated that variations of the invention in regards to the materials used, whether they be nylon, plastic, leather, metal, or polyester, cloth, suede, or any other type or makeup of the materials presented in this current embodiment, may be made without departing from the scope of the invention which is defined in the appending claims.

What is claimed is:

1. An attachment device that attaches the leg of a guitar or bass player to the end pin of a guitar or bass, for the purpose of anchoring the instrument in a stationary position, comprising:

A single length of strap (1,6,7)

A quick release adjustable buckle (4)

An adjustable buckle with loop end (5)

A leather strap end (2), attached to the loop end of (5), with end pin hole punched through it (3*a*).

2. The leg strap attachment device according to claim 1 wherein said leg strap is threaded into a quick-release single adjustable buckle (4).

3. The leg strap attachment device according to claim 1 wherein the strap then exits the buckle to create the strap "length" (7).

4. The leg strap attachment device according to claim 1 wherein the strap is then threaded through a second adjustable buck with loop end (5).

5. The leg strap attachment device according to claim 1 wherein a leather strap end (2) with end pin hole (3*a*) is attached to the second buckle (5) loop.

6. The leg strap attachment device according to claim 1 wherein the leather strap end is connected to the end pin of a guitar or bass.

7. The leg strap attachment device according to claim 1 wherein the strap is then looped through the second adjustable buckle (5).

8. The leg strap attachment device according to claim 1 Wherein the extra strap length (6) is used to adjust the length of the strap (7) between the leg (1) and the instrument end pin (3).

* * * * *